United States Patent [19]

Schafft

[11] Patent Number: 4,945,629

[45] Date of Patent: Aug. 7, 1990

[54] VERTICAL CARROUSEL

[75] Inventor: Ernst Schafft, Landau, Fed. Rep. of Germany

[73] Assignee: Bellheimer Metallwerk GmbH, Bellheim, Fed. Rep. of Germany

[21] Appl. No.: 245,790

[22] Filed: Sep. 16, 1988

[30] Foreign Application Priority Data

Sep. 18, 1987 [DE] Fed. Rep. of Germany ..... 3731871

[51] Int. Cl.[5] ..... B23Q 3/155

[52] U.S. Cl. ..... 29/568; 198/465.1; 211/1.5

[58] Field of Search ..... 29/568; 198/364.1, 465.1, 198/465.2; 408/71; 211/1.5

[56] References Cited

U.S. PATENT DOCUMENTS

| | | | |
|---|---|---|---|
| 3,234,648 | 2/1966 | Knowles | 29/568 |
| 3,499,555 | 3/1970 | Wahle | 214/16.4 |
| 4,186,588 | 2/1980 | Gorlitsyn et al. | 29/568 X |
| 4,249,652 | 2/1981 | Brems | 198/645.1 |
| 4,615,430 | 10/1986 | Satoh | 198/645.1 |
| 4,624,044 | 11/1986 | Bredow et al. | 29/568 |
| 4,656,861 | 4/1987 | Koyama et al. | 72/446 X |
| 4,676,560 | 6/1987 | Schmitz et al. | 312/268 |
| 4,680,955 | 7/1987 | Sakamoto | 72/446 X |
| 4,682,401 | 7/1987 | Tadashi et al. | 29/568 |

FOREIGN PATENT DOCUMENTS

| | | |
|---|---|---|
| 3133108 | 1/1983 | Fed. Rep. of Germany . |
| 3524344 | 1/1987 | Fed. Rep. of Germany . |
| 542138 | 9/1973 | Switzerland . |

*Primary Examiner*—Z. R. Bilinsky

*Attorney, Agent, or Firm*—Mark P. Stone

[57] ABSTRACT

A vertical carrousel, which serves in particular to store upper and lower tools for a bending machine, and has a loading and unloading opening in the front wall of its housing, is provided with an additional loading and unloading opening in the region of a side wall of the housing. The additional opening enables tools to be transferred between the vertical carrousel and the bending machine through the shortest distance through transfer bridges.

22 Claims, 2 Drawing Sheets

VERTICAL CARROUSEL

BACKGROUND OF THE INVENTION

The invention relates to a vertical carrousel having a plurality of bearers circulating in a housing, of which bearers one in each case can be transferred into the region of a loading and unloading opening provided on the front and/or rear side of the housing.

Vertical carrousels of the abovementioned type, which are also referred to as paternoster cabinets or paternoster conveyors, frequently have only one loading and unloading station, which is arranged on the front side of the housing and can be closed by at least one sliding door. Only in isolated cases, such as vertical carrousels, intended for use in large warehouses of industrial facilities, is a loading and unloading opening also provided on the housing rear side. Reasons favoring the arrangement of loading and unloading openings on the front or rear side of the housing are not only to conform to the basic design of a vertical carrousel but also to provide good accessability of the bearers of the vertical carrousel transferred into the region of the loading and unloading opening, over their entire width.

Investigations concerning the use of known vertical carrousels as tool stores in modern production systems have shown that the tool flow from the tool store to the machine tool is often unsatisfactory. For example, many changes in direction and comparatively long transfer distances cannot be avoided if the vertical carrousel is next to the machine tool fitted with tools.

SUMMARY OF THE INVENTION

The object of the invention is to provide a vertical carrousel which is suitable to a particular degree for use as a tool store in production facilities and which, when arranged alongside a machine tool, makes it possible to provide the shortest transfer distances between the vertical carrousel and machine tool. This object is achieved according to the invention by at least one side wall of the housing having, in the region of the loading and unloading opening on the front or rear side of the housing, at least one additional loading and unloading opening.

The vertical carrousel according to the invention offers the advantage that the additional loading and unloading opening of its housing makes possible a lateral linking-up of stations to be supplied with articles from the vertical carrousel. These stations are not necessarily formed by only machine tools, but, for example, are also formed by workplaces and also workpieces coming in as loading articles.

BRIEF DESCRIPTIONS OF THE DRAWINGS

Further details and features of the invention will be apparent from the subclaims and the following description of a particularly advantageous exemplary embodiment represented in the attached drawing, in which:

DESCRIPTION OF THE BEST MODES FOR CARRYING OUT THE INVENTION

Figure 1:
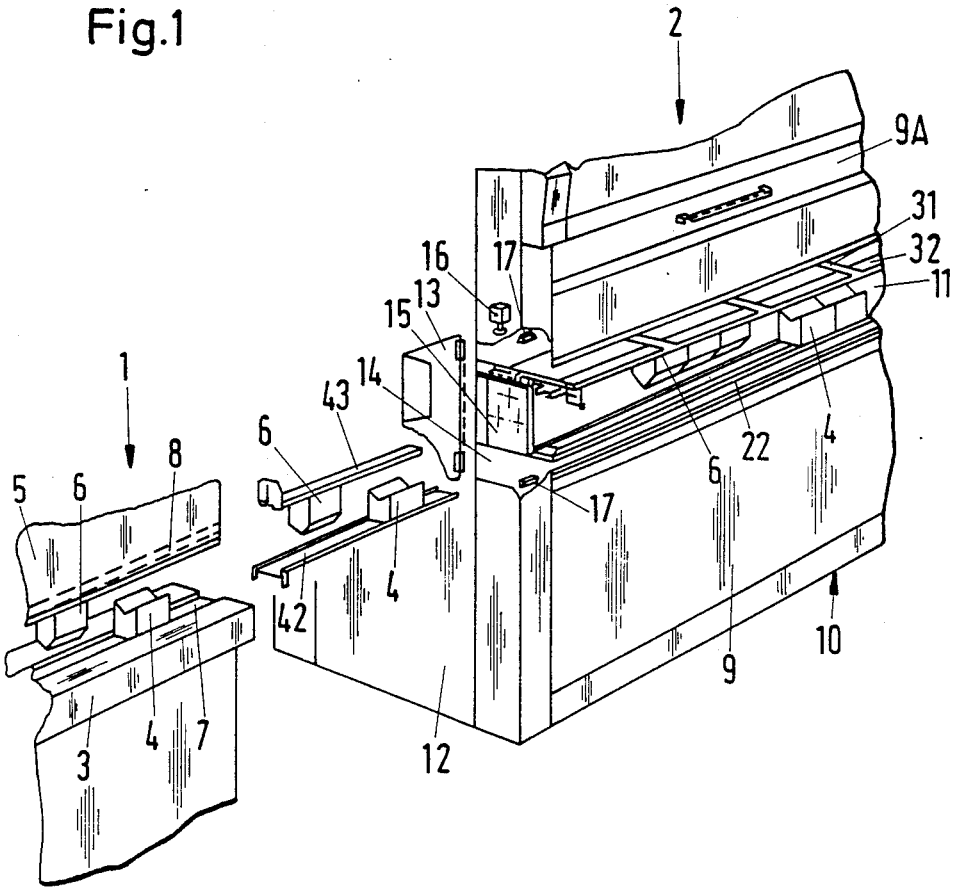
FIG. 1 shows the perspective view of parts of a vertical carrousel installed alongside a folding machine.
Figure 2:
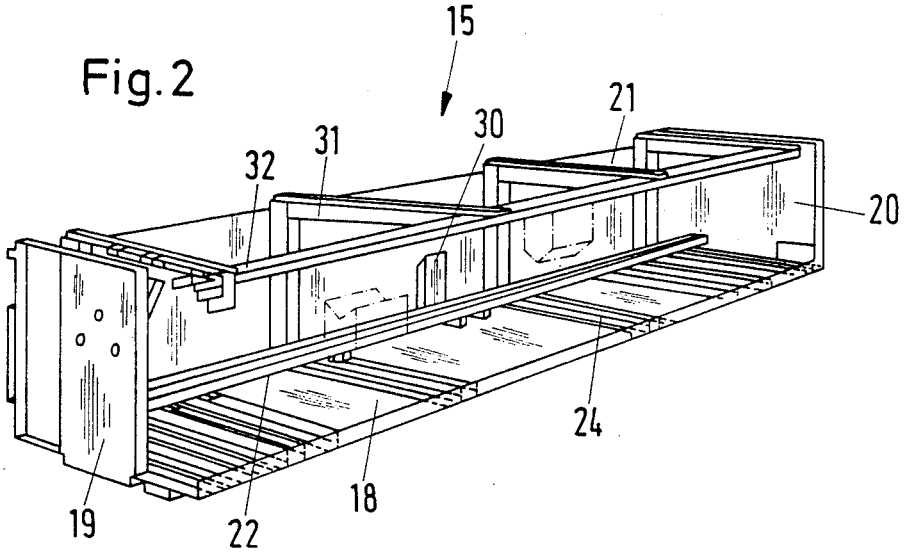
FIG. 2 shows the perspective view of a single bearer of the vertical carrousel represented in FIG. 1

In FIG. 1, 1 generally denotes a bending machine and 2 generally denotes a vertical carrousel.

The bending machine 1 has a table 3 for holding lower tools 4 and an upwardly and downwardly movable ram 5 for holding upper tools 6. The table 3 and ram 5 are provided with holders 7, 8 for the interchangeable tools corresponding to various work pieces.

The vertical carrousel 2 serves as a tool store for the bending machine 1. The front wall 9 of its housing 10 has, as is generally usual, a loading and unloading opening 11 which extends approximately over the entire housing width and can be closed by an upwardly and downwardly movable sliding door 9A. The housing 10 also has in the region of its side wall 12, and more precisely in the direct vicinity of the loading and unloading opening 11 and on the same level as the latter, an additional loading and unloading opening 14, which can be closed by a safety flap 13. The safety flap 13 prevents circulation of the bearers 15 of the vertical carrousel 2 in the opened state shown in the drawing, while it allows circulation in the closed state by acting on a limit switch 16, provided that such circulation is not otherwise prevented by other safety devices, including among others a light barrier 17.

Details of the structure of the bearer 15 are apparent from FIGS. 2 to 5. Each bearer 15 has a bottom 18, two side walls 19, 20 and a rear wall 21, the width of the side walls 19 being less than the depth of the bottoms 18 by an amount which is at least equal to the width of the additional loading and unloading opening 14.

An article holding carriage 22, which is equipped with a box-section rail 23 for holding the lower tools 4, is mounted displaceably back and forth on the bottom 18 of the bearer 15. In order to ensure easy mobility the article holding carriage 22, the latter is designed as a rolling container mounted on ball castors 25 guided in U-section rails 24.

Figure 3:
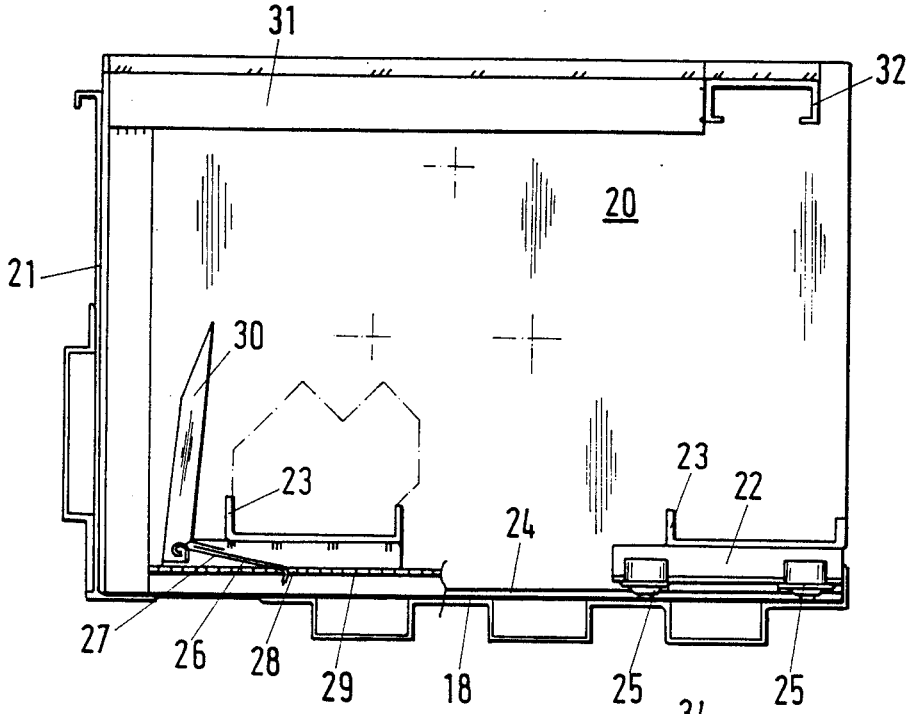
FIG. 3 shows a section through the bearer according to FIG. 2.
Figure 4:
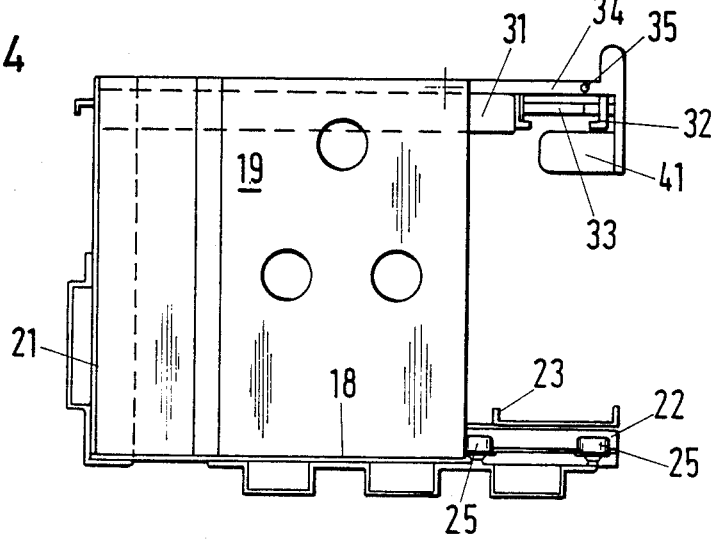
FIG. 4 shows a side view of the bearer according to FIGS. 2 and 3.
Figure 5:
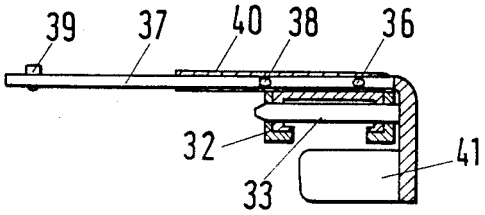
FIG. 5 shows, partly in section, a detail of the bearer according to FIGS. 2 to 4.

In the right-hand part of FIG. 3 and in FIG. 4, the article holding carriage 22 is shown in its loading and unloading position, while the left part of FIG. 3 shows the storage position of the article holding carriage 22. The article holding carriage 22 can be held in these positions by a locking element 26, the tip of which is pressed under the action of a spring 27 into catch holes 28 of a catch bar 29. The locking element 26 can be unlocked by pivoting a lever 30.

The upper tools 6 are held by a retaining rail 32, which is retained by spars 31 of supporting framework and at the end of which facing the additional loading and unloading opening 14 is arranged a block 33, which is retained by a leaf spring 34 in its blocking position, in which a blocking pin 35 fixed to the leaf spring 34 engages in a catch hole 36 of a slide 37 connected to the block 33. By pivoting of the leaf spring 34, the blocking pin 35 can be removed from the catch hole 36 and the block 33 can be transferred into its release position, in which the blocking pin 35 can engage a second catch hole 38 of the slide 37. An end stop 39 prevents the withdrawal of the slide 37 out of its guide 40.

At the bottom end of the slide 37 connected to the block 33 there is arranged a diaphragm 41 which, in the blocking position of the block 33 interrupts the light beam of the light barrier 17 and, in the blocking position, creates one of the preconditions for a circulating movement of the bearers 15.

Due to the fact that the article holding carriage 22 can be transferred out of its position shown on the right in FIG. 3 and into its position shown on the left in the same Figure, a balanced load distribution of the articles stored on the bearers 15 can be achieved to avoid, for example, tortional moments in the same direction exerted on the bearer 15 by articles suspended on the retaining rail 32 and mounted on the article holding carriage 22.

In practice, a set of lower and upper tools 4, 6 required for the production of a certain workpiece of a production program is stored in each case on one bearer 15 in each case. In order to be able to transfer in each case the tools required, which are frequently heavy, by the quickest and shortest distance from the bending machine 1 into the vertical carrousel 2 and vice versa, it is possible to provide article transfer bridges 42 and 43 between the bending machine 1 and the vertical carrousel 2. The longitudinal axes of the transfer bridges are in alignment with the longitudinal axes of the article holding carriage 22 transferred into loading and unloading position and of the retaining rail 32, as well as with the longitudinal axes of the holders 7 and 8. The tool change can consequently be accomplished by simple displacement of the tools without directional change.

I claim:

1. A vertical carrousel within a housing, said housing including front and rear ends and side walls disposed between said ends, at least one of said ends of said housing having a first loading and unloading opening, said vertical carrousel having a plurality of bearers, and means for circulating said bearers in said housing, said means for circulating including means for transferring said bearers into the region of said first loading and unloading opening, and at least one additional loading and unloading opening (14) defined in at least one of said side walls (12) of the housing (10) in the region of the first loading and unloading opening (11), and an article holding carriage (22) provided on at least one of said bearers (15), and means for displacing said article holding carriage from the front side of said at least one bearer to the rear side and back of said at least one bearer.

2. The apparatus as claimed in claim 1, further including a closure element for closing the additional loading and unloading opening (14) for preventing bearer circulation in the opened state.

3. The apparatus as claimed in claim 1 wherein the additional loading and unloading opening (14) is arranged in the region of the front third of the bearer (15) transferred into a loading and unloading position.

4. The apparatus as claimed in claim 2 wherein the additional loading and unloading opening (14) is arranged in the region of the front third of the bearer (15) transferred into a loading and unloading position.

5. The apparatus as claimed in claim 1, wherein the article holding carriage (22) is designed as a rolling container, and including means for guiding said article holding carriage, said means for guiding comprising the side walls (19, 20) of the bearer (15) for displacing said article holding carriage back and forth on the bottom (18) of the bearer.

6. The apparatus as claimed in claim 5 wherein the article holding carriage (22) has at least one locking element (26) for arresting said article holding carriage at least in its end positions.

7. The apparatus as claimed in claim 1, wherein the article holding carriage (22) has at least one locking element (26) for arresting said article holding carriage at least in its end positions.

8. The apparatus as claimed in claim 1, wherein the article holding carriage (22) includes means for keeping tools (5, 6).

9. The apparatus as claimed in claim 1, wherein the bearer (15) is equipped with a retaining rail (32) providing means for article suspension, the retaining rail (32) forms a store for upper tools (6), and the article holding carriage provides means for keeping tools and forms a store for lower tools (4) of a machine tool.

10. The apparatus as claimed in claim 1 including means for connecting said article holding carriage (22) to a machine tool arranged alongside it, said means for connecting comprising article transfer bridges (32, 34).

11. The apparatus as claimed in claim 10, wherein the article transfer bridges (42, 43) are in alignment with longitudinal axes of the article holding carriages (22) transferred into the region of the additional loading and unloading opening (14).

12. The apparatus as claimed in claim 1, wherein the article holding carriage (22) of at least one of said bearers (15) transferred into the loading and unloading station is arranged in alignment with holders (7, 8) for upper tools (6) and lower tools (4) of a machine tool.

13. The apparatus as claimed in claim 1, further including a sliding door (9A) mounted over said first loading and unloading opening in said housing (10) for selectively closing said first opening.

14. The apparatus as claimed in claim 1, wherein the bearer (15) including a retaining rail (32) providing means for article suspension.

15. The apparatus as claimed in claim 14 wherein the retaining rail (32) of the bearer (15) is located in a loading and unloading station and is arranged in alignment with the additional loading and unloading opening (14).

16. The apparatus as claimed in claim 15 including a releasable block (33) arranged at an end of the retaining rail (32) and facing the additional loading and unloading opening (14).

17. The apparatus as claimed in claim 14 including a releasable block (33) arranged at an end of the retaining rail (32) and facing the additional loading and unloading opening (14).

18. The apparatus as claimed in claim 1 wherein the bearers (15) include bottoms (18) and side walls (19), said bottoms of said bearers projecting beyond at least one of said side walls by a distance which is at least equal to the width of the additional loading and unloading opening (14).

19. The apparatus as claimed in claim 14, wherein the retaining rail (32) provides means for keeping tools.

20. The apparatus as claimed in claim 14, including means for connecting said retaining rail (32) to a machine tool arranged alongside it, said means for connecting comprising article transfer bridges (32, 34).

21. The apparatus as claimed in claim 20, wherein the article transfer bridges (42, 43) are in alignment with longitudinal axes of the retaining rails (32) and arranged in the region of the additional loading and unloading opening (14).

22. The apparatus as claimed in claim 14, wherein the retaining rail (32) of at least one of sai bearers (15) transferred into a loading and unloading station is arranged in alignment with holders (7, 8) for upper tools (6) and lower tools (4) of a machine tool.

* * * * *